US006044621A

United States Patent [19]

Malin et al.

[11] Patent Number: 6,044,621

[45] Date of Patent: Apr. 4, 2000

[54] ZIPPER STRIP AND METHOD OF POSITIONING THE STRIP TRANSVERSE LONGITUDINAL AXIS

[75] Inventors: Art Malin, Northbrook; Donald L. Van Erden, Wildwood, both of Ill.; James G. Kohl, Jr., Gardenridge, Tex.; Michael J. McMahon, Palatine, Ill.

[73] Assignee: Illinois Tool Works Inc., Glenview, Ill.

[21] Appl. No.: 09/074,567

[22] Filed: May 7, 1998

Related U.S. Application Data

[60] Division of application No. 08/839,974, Apr. 24, 1997, abandoned, which is a continuation-in-part of application No. 08/651,977, May 21, 1996, Pat. No. 5,672,009.

[51] Int. Cl.[7] ..... B65B 61/18

[52] U.S. Cl. ..... 53/412; 53/450; 493/214; 493/927

[58] Field of Search ..... 53/412, 133.4, 53/139.2, 450, 451, 550, 551; 493/213, 214, 927

[56] References Cited

U.S. PATENT DOCUMENTS

| | | | |
|---|---|---|---|
| 3,381,592 | 5/1968 | Ravel | 493/214 X |
| 3,948,705 | 4/1976 | Ausnit | 493/214 X |
| 3,986,914 | 10/1976 | Howard | 493/214 X |
| 4,532,652 | 7/1985 | Herrington | 383/103 |
| 4,617,683 | 10/1986 | Christoff | 53/179.2 X |
| 4,655,862 | 4/1987 | Christoff et al. | 493/927 X |
| 4,666,536 | 5/1987 | Van Erden et al. | 493/214 X |
| 4,709,398 | 11/1987 | Ausnit | 53/139.2 X |
| 4,844,759 | 7/1989 | Boeckmann | 493/927 X |
| 4,878,987 | 11/1989 | Ven Erden | 493/213 X |
| 4,909,017 | 3/1990 | McMahon et al. | 53/139.2 X |
| 4,956,963 | 9/1990 | Johnson | 53/450 X |
| 5,024,537 | 6/1991 | Tilman | 383/63 |
| 5,036,643 | 8/1991 | Bodolay | 53/128.1 |
| 5,461,845 | 10/1995 | Yeager | 53/451 |
| 5,462,360 | 10/1995 | Tilman et al. | 383/63 |
| 5,557,907 | 9/1996 | Malin et al. | 53/139.2 |
| 5,558,613 | 9/1996 | Tilman et al. | 493/214 |
| 5,573,614 | 11/1996 | Tilman et al. | 493/213 X |
| 5,660,479 | 8/1997 | May et al. | 383/204 |
| 5,664,303 | 9/1997 | Johnson . | |
| 5,672,009 | 9/1997 | Malin | 383/204 |
| 5,776,045 | 7/1998 | Bodolay et al. | 493/215 |
| 5,782,733 | 7/1998 | Yeager | 493/213 |
| 5,816,018 | 10/1998 | Bois | 53/133.4 |

*Primary Examiner*—Daniel B. Moon
*Attorney, Agent, or Firm*—Kane, Dalsimer, Sullivan and Levy, LLP

[57] ABSTRACT

A zipper strip for a reclosable bag or package includes a male interlocking profile and a female interlocking profile. The male interlocking profile includes a male interlocking member and a male web coextruded therewith. In like manner, the female interlocking profile includes a female interlocking member and a female web. The male interlocking member snappingly engages into the female interlocking member to join the profiles to one another. One of the male and female webs is wider than the other in at least one of two directions from the male and female interlocking members, the greater width being represented by at least one flange extending widthwise beyond the other web. The zipper strip is designed to be attached to thermoplastic sheet material by sealing the at least one flange thereto without sealing the male and female webs to each other. Methods for securing the zipper strip to thermoplastic sheet material, and for making packages on a horizontal form-fill-and-seal machine, are also disclosed.

12 Claims, 7 Drawing Sheets

ZIPPER STRIP AND METHOD OF POSITIONING THE STRIP TRANSVERSE LONGITUDINAL AXIS

CROSS REFERENCE TO RELATED APPLICATIONS

This is a division of U.S. patent application Ser. No. 08/839,974 filed on Apr. 24, 1997 now abandoned, which application is a continuation-in-part (CIP) of U.S. patent application Ser. No. 08/651,977 filed on May 21, 1996 now Pat. No. 5,672,009.

BACKGROUND OF THE INVENTION

1. Field of the Invention

The present invention relates to reclosable plastic bags of the type in which perishable food products and other goods are packaged for sale to consumers in retail outlets. More specifically, the present invention relates to reclosable plastic bags manufactured and concurrently filled on horizontal or vertical form-fill-and-seal (FFS) machines, wherein a plastic interlocking zipper for each bag is disposed transversely relative to the direction of motion of the thermoplastic sheet material used to form the reclosable bags on the FFS machine.

2. Description of the Prior Art

The present invention relates to improvements in the package-making art and may be practiced in the manufacture of thermoplastic bags and packages of the kind that may be used for various consumer products, but which are particularly useful for food products which must be kept in moisture- and air-tight packages, free from leakage until initially opened for access to the product contents, which packages are then reclosable by zipper means to protect any remainder of the product therein.

The indicated art is fairly well-developed, but nevertheless remains susceptible to improvement contributing to increased efficiency and cost effectiveness.

One problem that still hampers the production of packages from continuous zipper-equipped sheet material is the difficulty in attaining a satisfactory sealing of the bag or package against leakage, where the zipper and area of film engaged by the zipper extends through the side (cross) seal areas separating one bag or package from the next. This problem occurs where the zipper is longitudinal with respect to the direction of motion of the thermoplastic sheet material used to form the reclosable bags on the FFS machine, in which case the transverse, or side, sealing bars must flatten and seal the zipper at the same time as they are sealing the thermoplastic sheet material from which the packages are being made. The difficulty with which this is consistently and successfully achieved is reflected by the high occurrence of leaking packages.

Numerous attempts have been made to solve this problem. Among the approaches that have been taken is the substitution of a transverse zipper for the longitudinal zipper. Where such a zipper is provided the transverse sealing bars associated with the FFS machine do not flatten the zipper as they are making a side seal, although they may seal the zipper to the thermoplastic sheet material transversely thereacross without flattening it.

The present invention relates to the provision of a transverse zipper for reclosable plastic bags or packages being manufactured on either a horizontal or vertical FFS machine. More specifically, the present invention is both a zipper strip and a method for securing the zipper strip transversely across the thermoplastic sheet material from which reclosable bags are being produced on a FFS machine.

SUMMARY OF THE INVENTION

Accordingly, the present invention is a zipper strip for a reclosable bag or package manufactured and filled using a form-fill-and-seal machine. In particular, the zipper strip is designed to be disposed transversely with respect to the movement through the machine of the thermoplastic sheet material used to fashion the packages.

The zipper strip comprises a male interlocking profile, having a male interlocking member and a male web coextruded therewith; and a female interlocking profile, having a female interlocking member and a female web coextruded therewith. The male interlocking member is snappingly engagable within the female interlocking member to join the male and female interlocking profiles together.

One of the male and female webs is wider than the other of the male and female webs in at least one of two directions from the male and female interlocking members in the closed zipper strip. The greater width of the wider of the male and female webs means that it has a flange extending beyond the other web on one and possibly both sides. The zipper strip, as a consequence, may be attached transversely upon thermoplastic sheet material by sealing the flange of the male or female web or flanges thereto without sealing the male and female webs to each other.

The present invention also comprises a method for attaching this zipper strip transversely on a sheet of thermoplastic sheet material during the production of plastic bags or packages on an FFS machine. In this situation, a length of the zipper strip is attached to the thermoplastic sheet material, each time it is brought to rest as it advances (incrementally or continuously) on or to the FFS machine.

This method includes the step of providing a zipper strip of the above-described variety. The length of zipper strip is then disposed transversely upon the sheet of thermoplastic sheet material, with the wider of the male and female webs in contact with the sheet and with a flange, or the flange if there is only one, oriented in the direction of the motion of the sheet. The flange or flanges are then sealed to the sheet without sealing the male and female webs to each other. Several specific ways of disposing the length of zipper strip onto the sheet of thermoplastic sheet material will be described below.

Finally, the present invention comprises a method for manufacturing reclosable packages on a horizontal form-fill-and-seal machine. The method includes the step of providing a sheet of thermoplastic sheet material having a length of zipper strip attached thereto at regularly spaced intervals as described above. A product conveyor then deposits a product to be packaged at regular intervals onto the sheet of thermoplastic sheet material. The two lateral edges of the sheet are then folded toward one another and around the product, and sealed to one another to form a tube therefrom enclosing the product.

The tube is then sealed transversely to each length of zipper strip without the webs of the male and female interlocking profiles being sealed to each other. The tube is then cut transversely adjacent to each length of zipper strip to separate each completed package from the next.

The present inventions will now be described in more complete detail with frequent reference being made to the figures identified below.

DETAILED DESCRIPTION OF THE PREFERRED EMBODIMENTS

Figure 1:
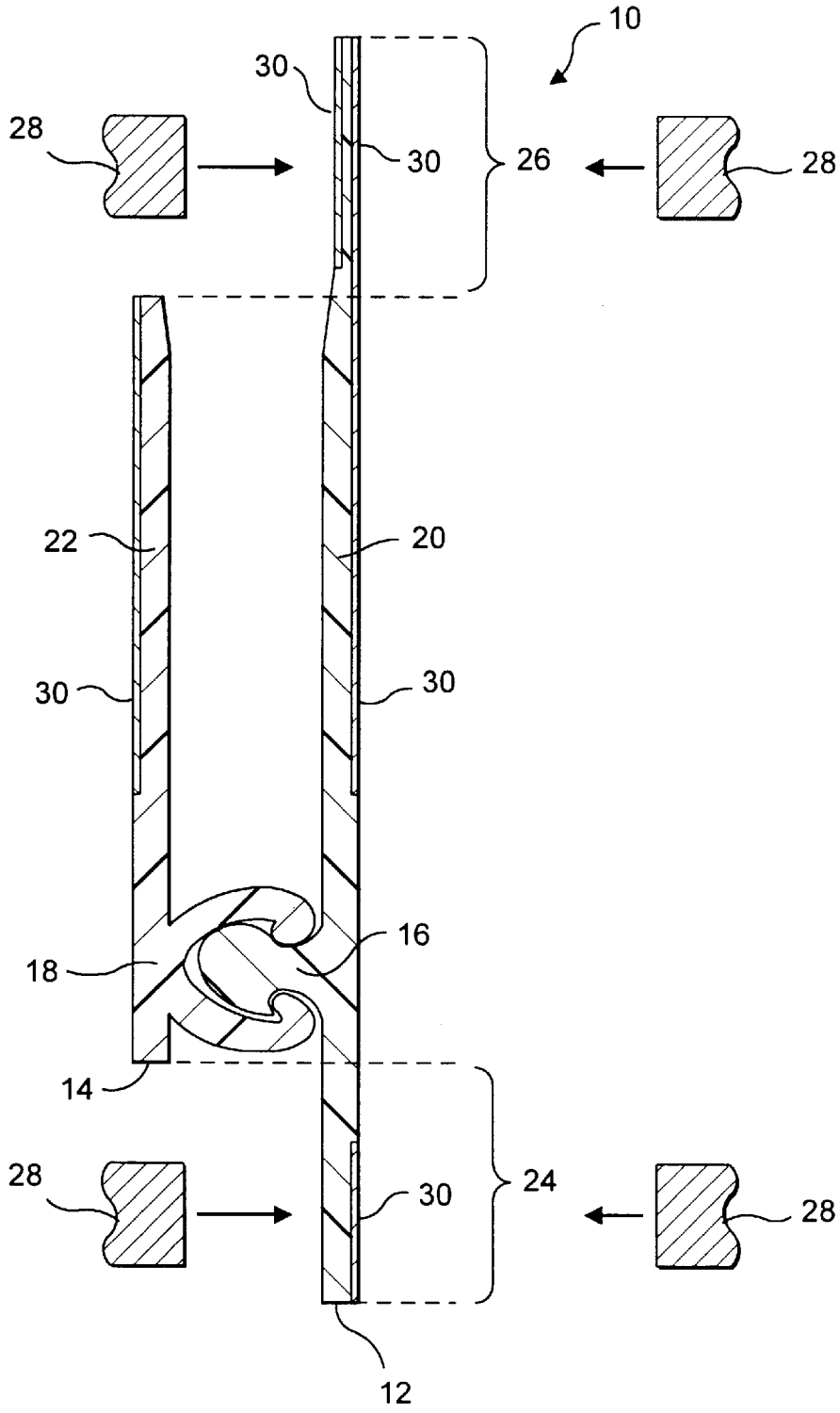
FIG. 1 is a cross-sectional view of a first embodiment of the zipper strip of the present invention.

Referring specifically to the figures identified above, FIG. 1 is a cross-sectional view of a first embodiment of the zipper strip 10 of the present invention. The zipper strip 10 comprises a male interlocking profile 12 and a female interlocking profile 14. The male interlocking profile 12 includes a male interlocking member 16 which may have an arrowhead-shaped cross section or, as is shown in FIG. 1, an asymmetrical arrowhead-shaped cross section, designed to make the zipper strip 10 easier to open from one side than from the other. The female interlocking profile 14 includes a female interlocking member 18 comprising two inwardly curving members forming a receptacle or channel into which male interlocking member 16 may be snappingly engaged.

Both the male and female interlocking profiles 12, 14 include webs coextruded with the male and female interlocking members 16, 18. Web 20 of male interlocking profile 12, it may be observed, is wider than web 22 of female interlocking profile 14. As a consequence, web 20 has a leading flange 24 and a trailing flange 26, which together make up the amount by which web 20 is wider than web 22. As will become clear below the leading and trailing flanges 24, 26 are so called because, when zipper strip 10 is attached to a thermoplastic sheet material being fed into an FFS machine, the leading flange 24 "leads" the transversely attached zipper strip 10 toward the machine, and the trailing flange 26 "trails" or is last. Ultimately, the leading flange 24 resides inward of the mouths of the plastic bags or packages being manufactured and concurrently filled with a consumer product on an FFS machine. While the male interlocking profile 12 is shown to have both the leading and trailing flanges 24, 26, both flanges 24, 26 could alternatively be part of the female interlocking profile 14 instead.

The zipper strip 10 is disposed transversely across thermoplastic sheet material during the manufacture of plastic bags or packages on an FFS machine. The zipper strip 10 is dispensed with male and female interlocking profiles 12, 14 joined as shown in FIG. 1 onto thermoplastic sheet material with the male interlocking profile 12 resting thereupon. Heat seal bars 28 or the like, applied against the leading and trailing flanges 24, 26 as suggested by the arrows in FIG. 1, seal the male interlocking profile 12 to the thermoplastic sheet material (not shown) without sealing web 22 of the female interlocking profile 14 to web 20 of the male interlocking profile 12.

Heat seal materials 30 may be applied to the outside of web 20 of male interlocking profile 12, including the outsides of the leading and trailing flanges 24, 26, as well as to the inside of the trailing flange 26 and to the outside of web 22 of the female interlocking profile 14, to facilitate their being sealed to thermoplastic sheet material. The trailing flange 26 may also be separable from the rest of web 20 by perforations.

The outsides of the leading and trailing flanges 24, 26 are attached to thermoplastic sheet material before the sheet material reaches the shoulder on a vertical FFS machine, or before the sheet material enters the FFS machine. Later, when the sheet material is folded over to form a tube with lateral edges sealed in a fin or overlap seal, the sheet material is sealed to the inside of trailing flange 26, as well as to the outsides of both webs 20, 22, without sealing the facing portions of webs 20, 22 to one another.

Figure 2:
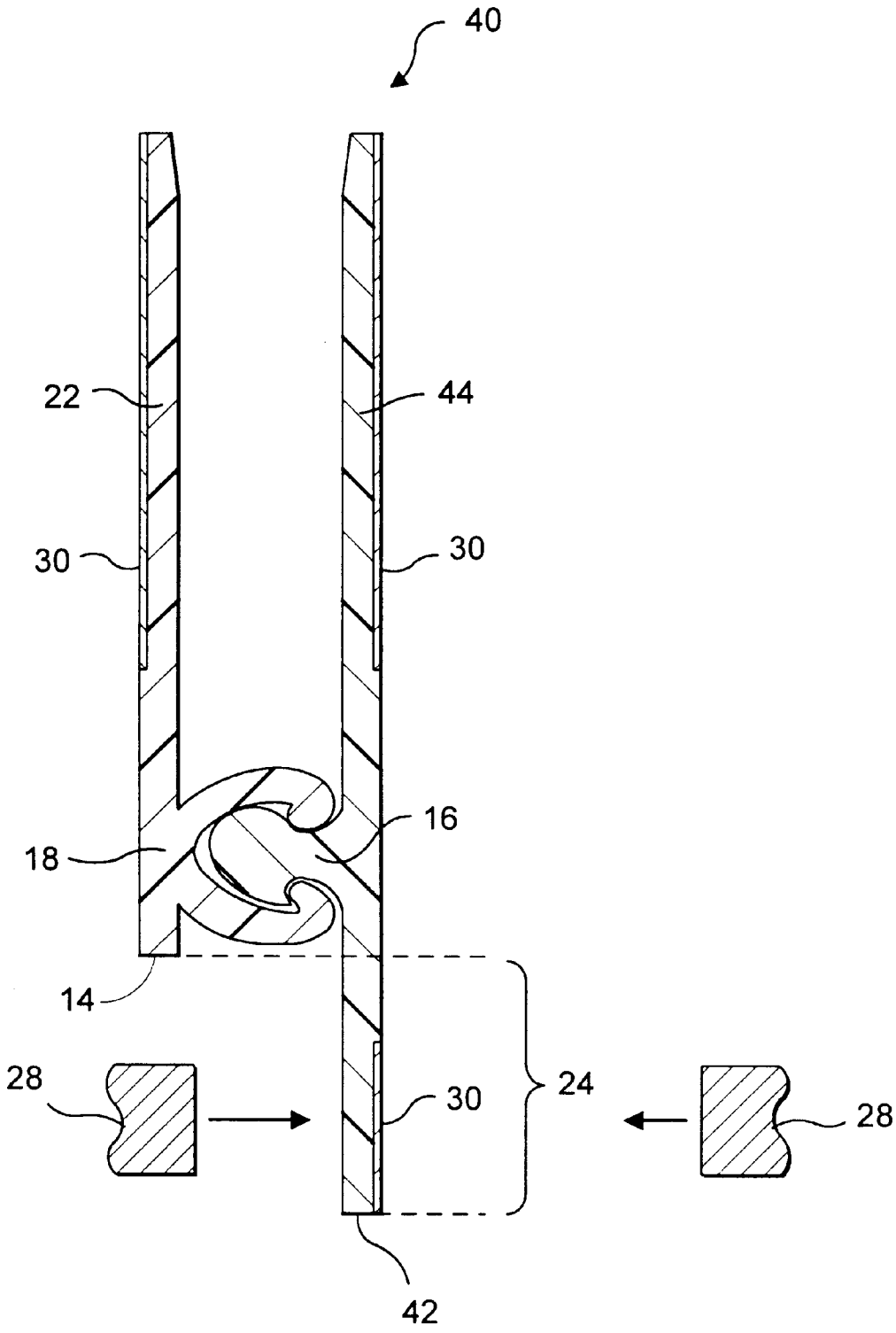
FIG. 2 is a cross-sectional view of a second embodiment of the zipper strip.

FIG. 2 is a cross-sectional view of a second embodiment of the zipper strip 40 of the present invention. Elements common to both zipper strip 40 and zipper strip 10 described above are identified in FIG. 2 using the same reference numbers. A comparison between FIGS. 1 and 2 indicates that zipper strip 40 lacks a trailing flange 26, but is identical to zipper strip 10 in all other respects. As was the case with zipper strip 10, zipper strip 40 is disposed transversely across thermoplastic sheet material during the manufacture of plastic bags or packages on an FFS machine. Male interlocking profile 42 rests upon the thermoplastic sheet material. Heat seal bars 28 or the like, applied against the leading flange 24, as suggested by the arrows in FIG. 2, seal the male interlocking profile 42 to the thermoplastic sheet material (not shown) without sealing web 22 of the female interlocking profile 14 to web 44 of the male interlocking profile 42. As before, while the male interlocking profile 42 is shown to have the leading flange 24, leading flange 24 could alternatively be part of the female interlocking profile 14 instead.

Both zipper strips 10, 40 shown in FIGS. 1 and 2, respectively, may be extruded from a polymeric resin material, such as a low-density polyethylene (LDPE). Heat seal materials 30 may be applied as shown by coextrusion or by coating following the extrusion of zipper strips 10, 40. Ethylene vinyl acetate (EVA) copolymers may be used as the heat seal materials 30.

Figure 3:
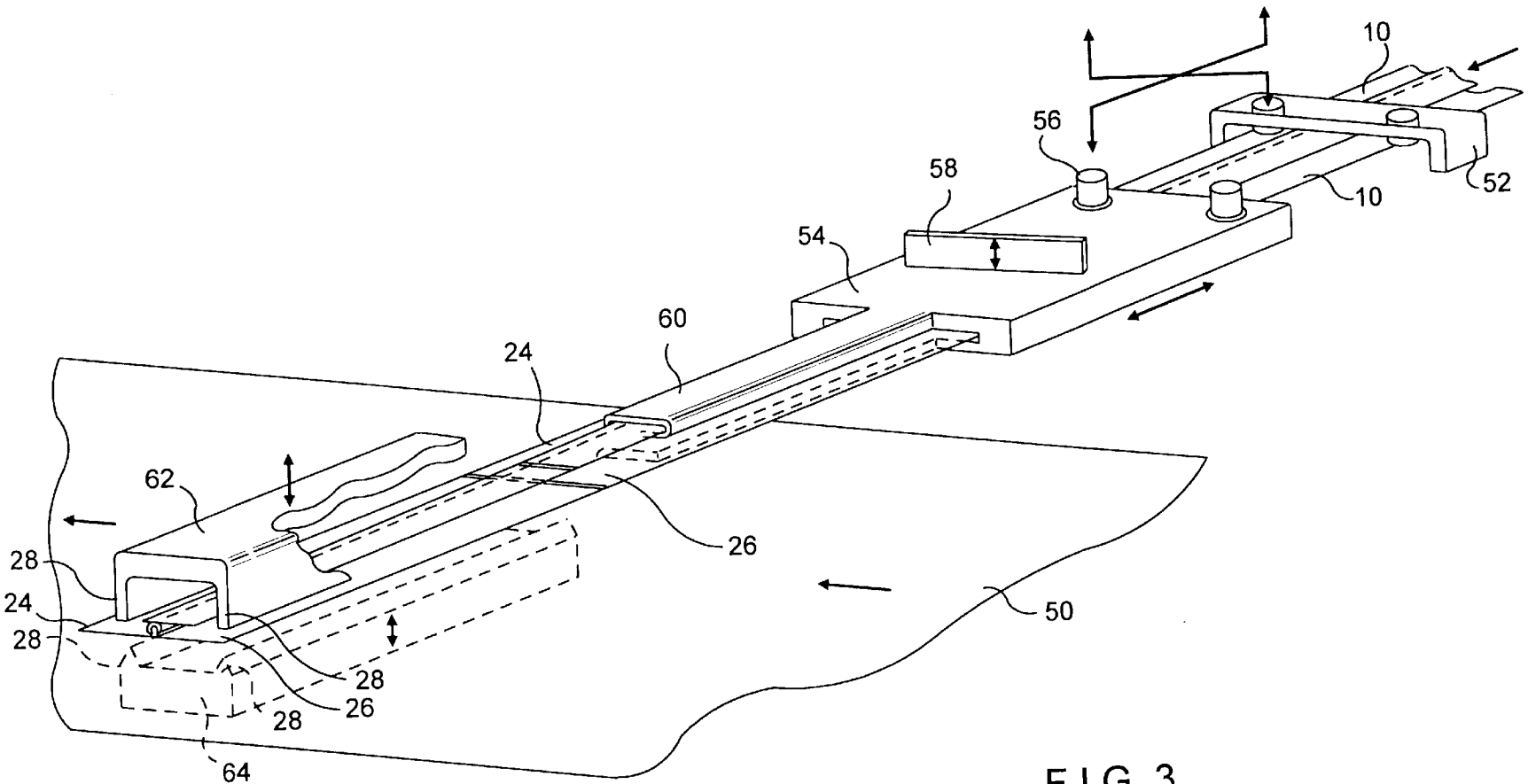
FIG. 3 is a perspective view of an apparatus used to attach the zipper strip to thermoplastic sheet material.

FIG. 3 is a perspective view of an apparatus used to attach zipper strip 10 to thermoplastic sheet material 50, which is conveyed in the direction of the arrows thereon toward an FFS machine. Thermoplastic sheet material 50 is moved intermittently in increments equal in length to the length of the packages being produced.

Each time the thermoplastic sheet material 50 is momentarily brought to rest, a length of zipper strip 10 is sealed transversely across the upwardly facing side thereof. Zipper tape 10 is dispensed from a roll or other supply not shown in FIG. 3, and fed through a stationary clamp 52, and through a reciprocating shuttle 54, which includes a clamp 56 and a guillotine 58, the latter of which is used to cut the zipper strip 10 when required.

Shuttle 54 reciprocates each time the thermoplastic sheet material 50 is momentarily brought to rest. When shuttle 54 moves outward over thermoplastic sheet material 50, clamp 56 is closed onto zipper tape 10, while stationary clamp 52 is open, so that shuttle 54 pulls a length of the zipper tape 10 from the roll. The outward end of shuttle 54 is a probe 60, which allows the leading flange 24 and the trailing flange 26 of the zipper tape 10 to protrude from the sides thereof.

As shown in FIG. 3, the shuttle 54 is in its retracted position. When in its forward position, not shown, the probe 60 extends into the space between the top sealing jaw 62 and its corresponding bottom sealing jaw 64, the latter of which is on the underside of the thermoplastic sheet material 50. The leading and trailing flanges 24, 26 extend outward from between the top and bottom sealing jaws 62, 64. When the jaws 62, 64 close, heat seal bars 28 seal the flanges 24, 26 to the thermoplastic sheet material 50. Jaws 62, 64 then are opened; guillotine 58 cuts the next length of zipper strip 10; clamp 56 is opened; and clamp 52 is closed. Then shuttle 54 retracts to the position shown in FIG. 3, while thermoplastic sheet material 50 moves a length equal to the length of a package being manufactured to repeat the process.

Figure 4:
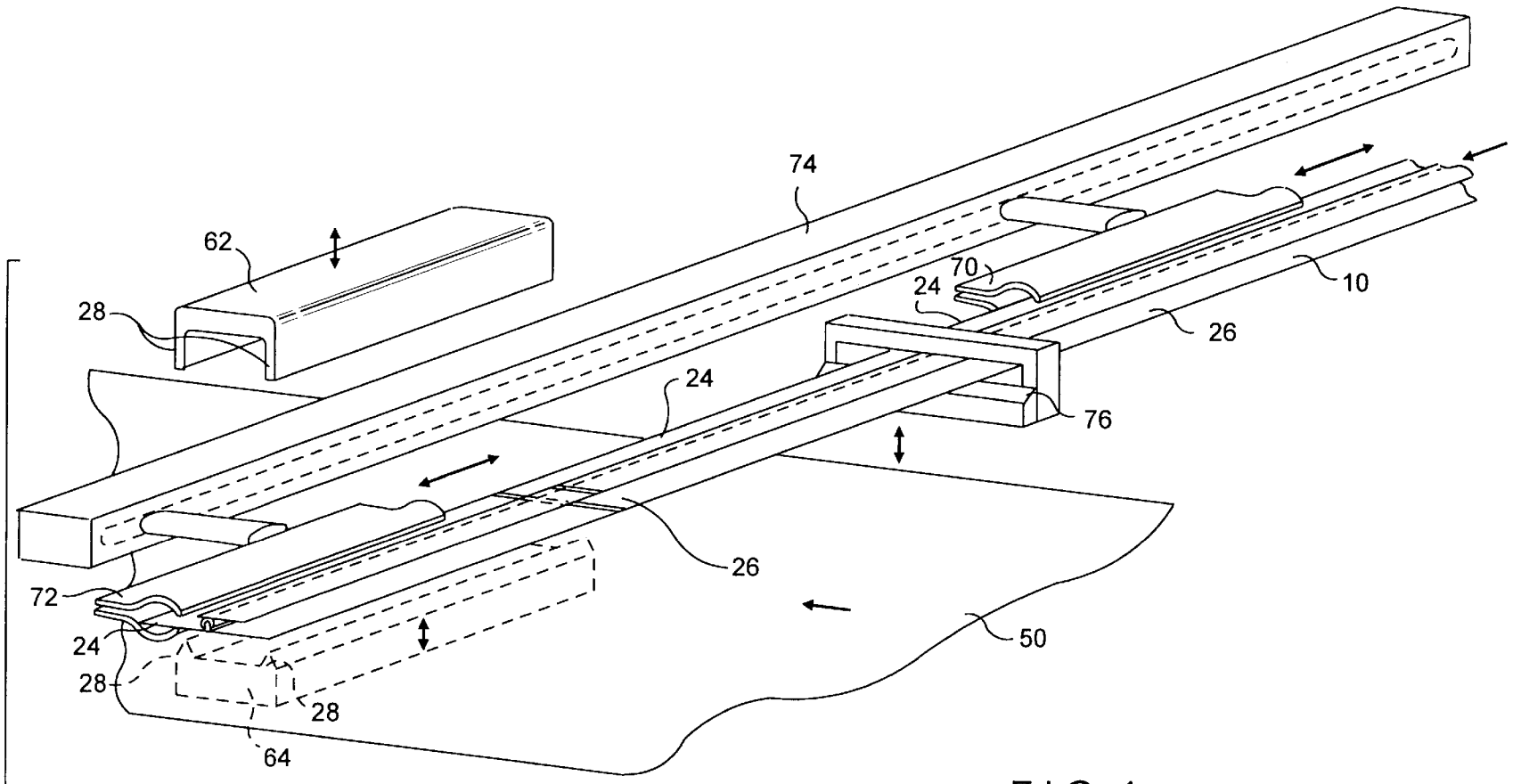
FIG. 4 is a perspective view of an alternate apparatus used for this purpose.

FIG. 4 is a perspective view of an alternate apparatus used to attach zipper strip 10 to thermoplastic sheet material 50. As before, thermoplastic sheet material 50 is conveyed in the direction of the arrow thereon toward an FFS machine, and is moved intermittently in increments equal in length to the length of the packages being produced.

Again, each time the thermoplastic sheet material 50 is momentarily brought to rest, a length of zipper strip 10 is sealed transversely across the upwardly facing side thereof. Zipper strip 10 is dispensed from a roll or other supply not shown in FIG. 4, being pulled therefrom by a first clamp 70, which reciprocates back and forth along mechanism 74 in step with a second clamp 72. First and second clamps 70, 72 grasp leading flange 24 of zipper strip 10 to pull the zipper strip 10 transversely across the thermoplastic sheet material. Second clamp 72 holds the zipper strip 10 in position while it is being sealed to the upwardly facing side of the thermoplastic sheet material 50. A stationary guillotine 76 is used to cut the zipper strip 10 when required.

Each time the thermoplastic sheet material 50 is momentarily brought to rest, second clamp 72 brings a length of zipper strip 10 cut by stationary guillotine 76 transversely outward thereover to the position shown in FIG. 4. At the same time, first clamp 70, moving in step with second clamp 72, moves a length of zipper strip 10 through guillotine 76. Top sealing jaw 62 and its corresponding bottom sealing jaw 64, the latter of which is on the underside of the thermoplastic sheet material 50, seal the leading flange 24 and the trailing flange 26 of the zipper strip 10 thereto, while the second clamp 72 holds onto the leading flange 24. Then, first clamp 70 and second clamp 72 retract from the positions shown in FIG. 4, the first clamp 70 retracting to a position adjacent to guillotine 76, and the second clamp 72 retracting upstream from the guillotine 76 along zipper strip 10. Thermoplastic sheet material 50 then moves a length equal to the length of a package being manufactured to repeat the process.

Figure 5:
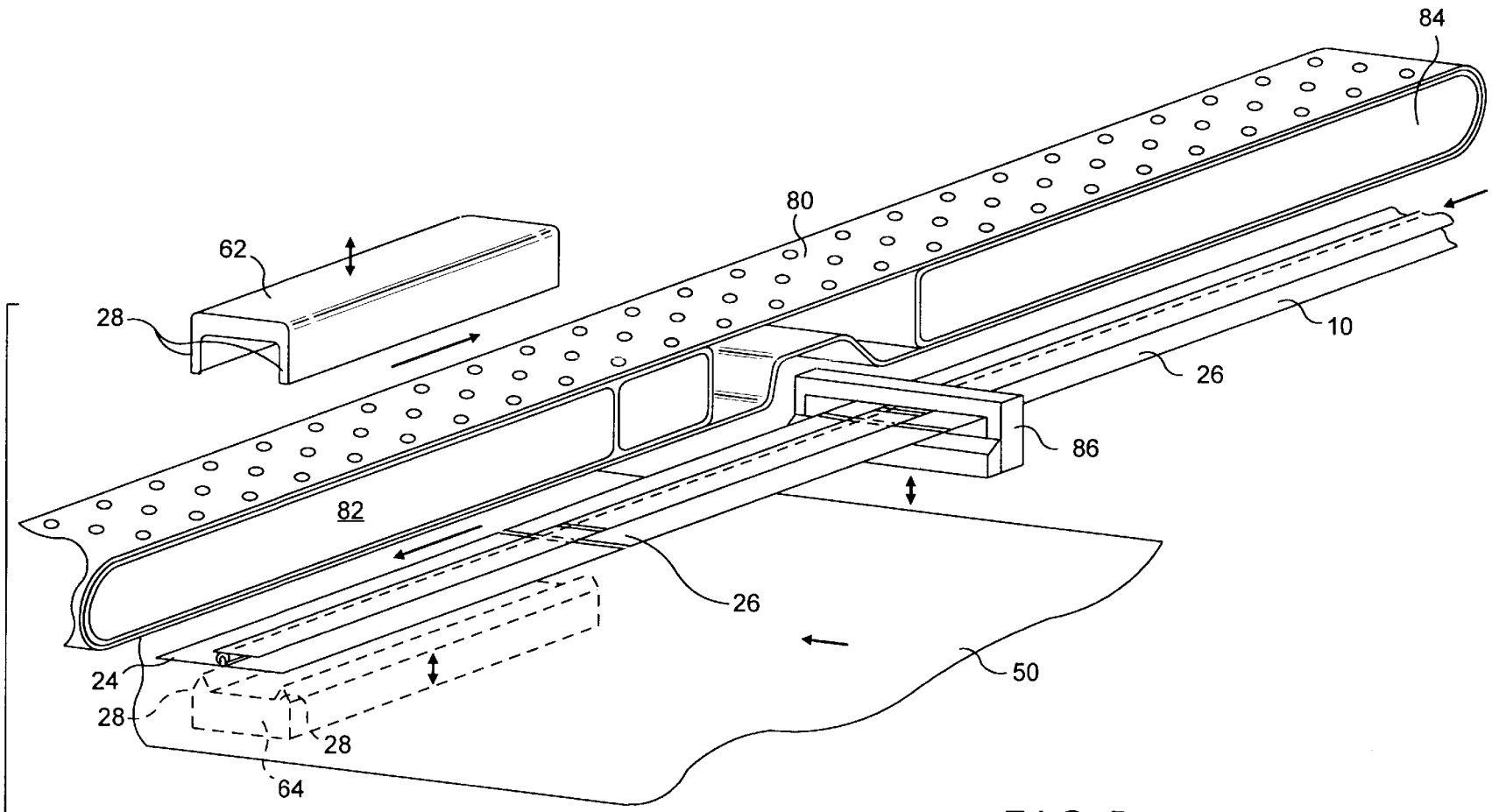
FIG. 5 is a perspective view of still another apparatus used for this purpose.

FIG. 5 is a perspective view of another apparatus used to attach zipper strip 10 to thermoplastic sheet material 50. Thermoplastic sheet material 50 is conveyed in the direction of the arrow thereon toward an FFS machine, and, as before, is moved intermittently in increments equal in length to the length of the packages being produced.

Again, each time the thermoplastic sheet material 50 is momentarily brought to rest, a length of zipper strip 10 is sealed transversely across the upwardly facing side thereof. Zipper strip 10 is dispensed from a roll or other supply not shown in FIG. 5, being pulled therefrom by a perforated belt 80 entrained about chambers 82, 84 attached to a vacuum or suction. Suction through the perforated belt 80 is used to transport the zipper strip 10. A stationary guillotine 86, through which the zipper strip 10 passes, is used to cut the zipper strip 10 when required.

Each time the thermoplastic sheet material 50 is momentarily brought to rest, perforated belt 80 draws a length of zipper strip 10 transversely across thermoplastic sheet material 50. The leading flange 24 and the trailing flange 26 of the zipper strip 10 extend beyond the two sides of the perforated belt 80 and chamber 82, which extend into the space between the top sealing jaw 62 and its corresponding bottom sealing jaw 64, the latter of which is on the underside of the thermoplastic sheet material 50. The leading and trailing flanges 24, 26 extend outward from between the top and bottom sealing jaws 62, 64. The vacuum is turned off. When the jaws 62, 64 close, heat seal bars 28 seal the flanges 24, 26 to the thermoplastic sheet material. The jaws 62, 64 are then opened, and the thermoplastic sheet material 50 is moved a length equal to the length of a package being manufactured. The vacuum is then turned on; guillotine 86 cuts the zipper strip 10; and the perforated belt 80 draws the portion of zipper strip 10 transversely across the thermoplastic sheet material 50 to repeat the process.

Figure 6:
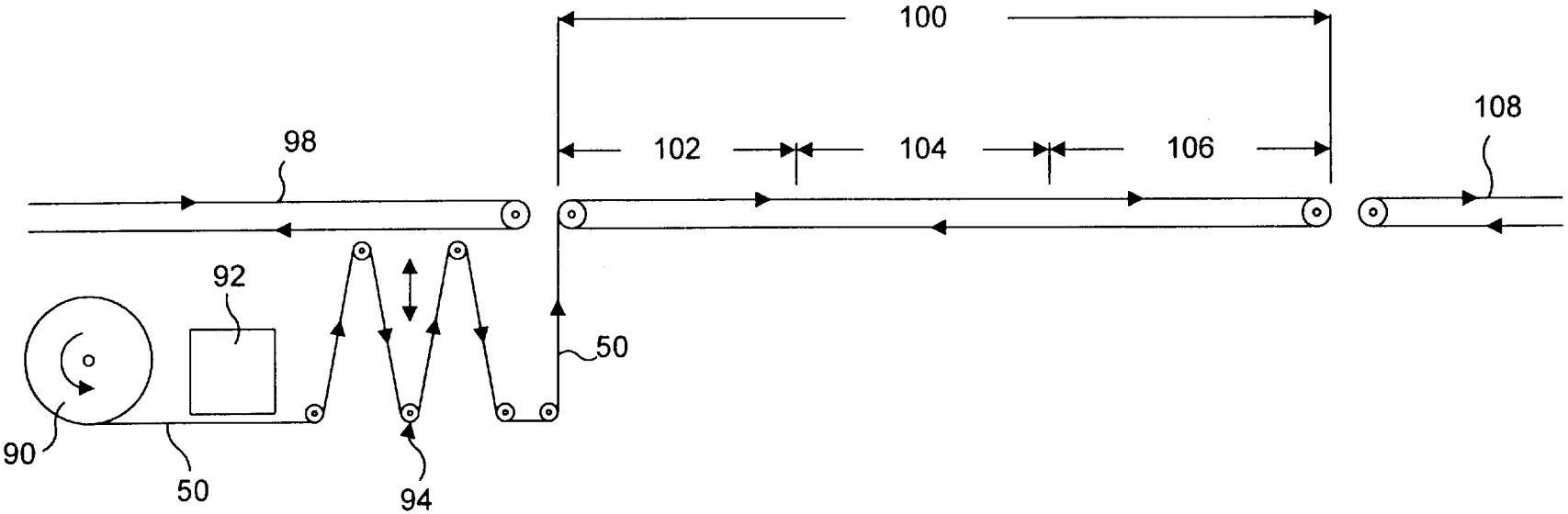
FIG. 6 is a schematic view of a horizontal FFS machine.
Figure 7:
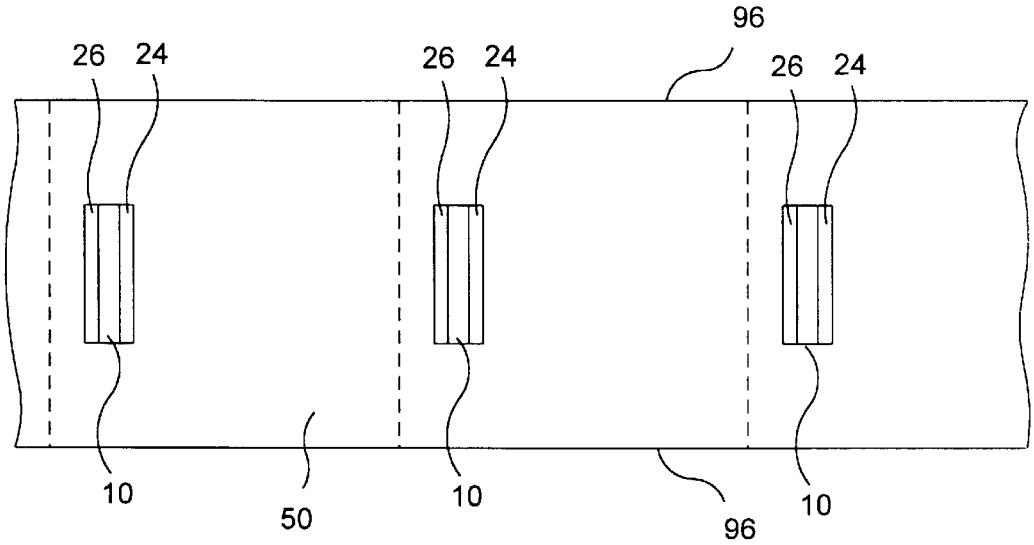
FIG. 7 is a plan view of the thermoplastic sheet material, with lengths of zipper strip attached thereto, used to produce packages on the horizontal FFS machine.

Any of these preceding apparatus for attaching a zipper strip 10 to thermoplastic sheet material 50 may be used in the manufacture of packages on a horizontal or vertical FFS machine. In this regard, FIG. 6 is a schematic view of a horizontal apparatus. A roll 90 of thermoplastic sheet material 50 dispenses the sheet 50 intermittently in lengths equal to that of the packages being manufactured and filled. A length of zipper strip 10 is applied by the zipper applicator 92, which may include any of the three apparatus described, to the center of the sheet material 50, as shown in FIG. 7, leaving sufficient material along the two lateral edges 96 of the sheet material 50 to fold over toward one another for joining in an overlap or fin seam.

An accumulator 94 is used to convert the intermittent motion of the thermoplastic sheet material 50 to a continuous motion.

A product conveyor 98 carries the product 99 to be packaged toward the wrapping machine 100, which comprises a forming area 102, a sealing area 104, and a cross-seal area 106. In the forming area 102, the two lateral edges 96 of the sheet material 50 are folded upward and around the product. In the sealing area 104, the two lateral edges 96 are sealed to one another with a fin or lap seal to form a continuous film tube with the product and zipper strips 10 inside. In the cross-seal area, the webs of the zipper strip 10 are sealed to the sheet material 50, without sealing the webs to each other, and the packages are separated from one another along lines 112, and carried onward by the takeaway conveyor 108.

Figure 8:
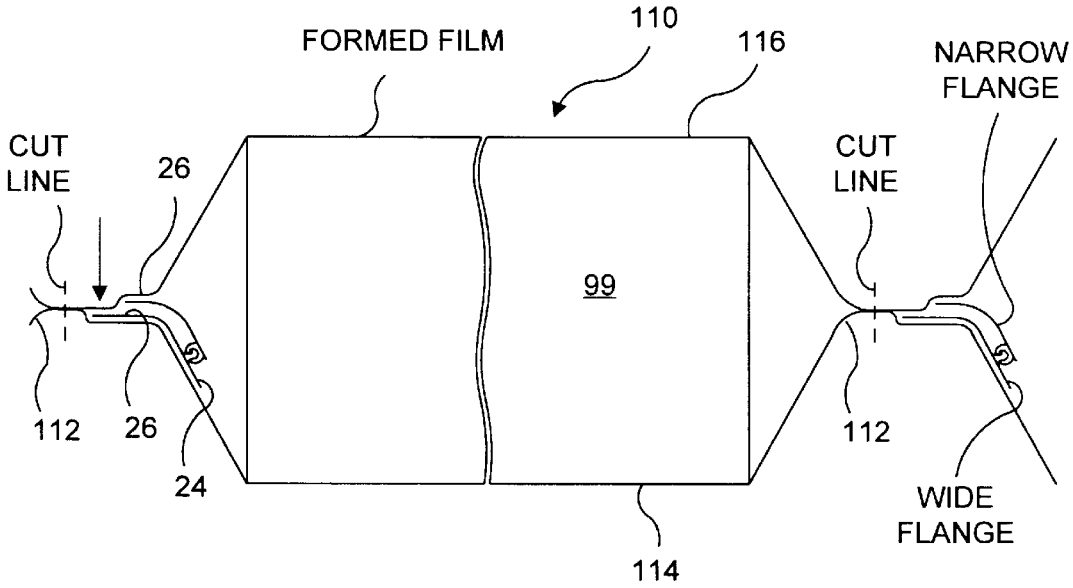
FIG. 8 is a simplified cross-sectional view of a package formed in a horizontal FFS machine in accordance with the present invention.

FIG. 8 depicts a package 110 formed in accordance with the above and containing therein the product 99. In this package the top (wide) flange 26 of one of the profiles is sealed to the portions of the film web forming the package bottom 114 as well as the package top 116. The other wide flange 24 of that profile is secured to the portions of the film web forming the package bottom 114 while the narrow flange 22 of the other profile is secured only to the portions of the film web forming the package top 116.

Modifications to the above would be obvious to those of ordinary skill in the art, but would not bring the invention so modified beyond the scope of the appended claims.

What is claimed is:

1. A method for manufacturing reclosable packages on a horizontal form-fill-and-seal machine, said method comprising the steps of:

providing a sheet of thermoplastic sheet material having at regular intervals therealong a length of zipper strip attached transversely across the center thereof and having strips without zipper strip along two lateral edges thereof, said zipper strip having interlocked male and female interlocking profiles, one of said male and female interlocking profiles having a web wider than that of the other on at least one of two lateral sides thereof, the greater width of the wider web being at least one flange running therealong, said one of said male and female interlocking profiles having said wider web being attached to said sheet, and the other of said male and female interlocking profiles not being in contact with said sheet said at least one flange being oriented in a direction of motion of said sheet on said horizontal form-fill-and-seal machine, said at least one flange being sealed to said sheet to attach said interlocked male and female interlocking profiles thereto;

providing a product conveyor to deposit a product to be packaged onto said sheet of thermoplastic sheet material;

folding said two lateral edges of said sheet of thermoplastic sheet material toward one another and around said product;

sealing said two lateral edges of said sheet to one another to form a tube therefrom enclosing said product;

sealing said tube transversely to each said length of zipper strip without sealing said webs of said male and female interlocking profiles to each other; and cutting said sealed tube to separate each completed package from the next.

2. A method of making reclosable packages comprising the steps of:

providing a sheet of thermoplastic sheet material and advancing said thermoplastic sheet material in amounts equal in length to that of said packages;

providing a zipper strip having interlocked male and female interlocking profiles, one of said male and female interlocking profiles having a web wider than that of the other on at least one of two lateral side thereof, the greater width of the wider web being at least one flange running therealong;

disposing a length of said zipper strip transversely upon said sheet of thermoplastic sheet material, said one of said male and female interlocking profiles having said wider web being in contact with said sheet and being oriented in the direction of the motion of said sheet;

sealing said at least one flange to said sheet of thermoplastic material;

forming a package; and thereafter sealing said webs of said male and female interlocking profiles to said package without sealing said webs to each other.

3. A method of making reclosable packages comprising the steps of:

providing a sheet of thermoplastic sheet material having two lateral edges and advancing said thermoplastic sheet material in amounts equal in length to that of said packages;

providing a zipper strip having interlocked male and female interlocking profiles, one of said male and female interlocking profiles having a web wider than that of the other on at least one of two lateral side thereof, the greater width of the wider web being at least one flange running therealong;

disposing a length of said zipper strip transversely upon said sheet of thermoplastic sheet material, said one of said male and female interlocking profiles having said wider web being in contact with said sheet and being oriented in the direction of the motion of said sheet;

sealing said at least one flange to said sheet of thermoplastic sheet material;

folding said thermoplastic sheet material so as to bring said lateral edges together;

sealing said lateral edges together to form a tube;

sealing said tube to said length of zipper strip without sealing said webs of said male and female interlocking profiles to each other; and cutting said package to remove a completed package from said tube.

4. A method for attaching a zipper strip transversely on a sheet of thermoplastic sheet material during the production of plastic bags or packages having transverse zippers on a form-fill-and-seal machine, said sheet being advanced in amounts equal in length to that of the bags or packages being manufactured, a length of zipper strip being attached each time said sheet is advanced by a bag length, said method comprising the steps of:

providing a zipper strip having interlocked male and female interlocking profiles, one of said male and female interlocking profiles having a web wider than that of the other on at least one of two lateral side thereof, the greater width of the wider web being at least one flange running therealong;

disposing a length of said zipper strip transversely upon said sheet of thermoplastic sheet material, said one of said male and female interlocking profiles having said wider web being in contact with said sheet and the other of said male and female interlocking profiles not being in contact with said sheet; and sealing said wider web onto said sheet of thermoplastic material without sealing said webs of said male and female interlocking profiles to each other.

5. A method as claimed in claim 4 wherein one of said male and female interlocking profiles has a web wider than that of the other on both of two lateral sides thereof, the greater width of the wider web being a flange running along each lateral side thereof.

6. A method as claimed in claim 4 wherein the step of disposing a length of said zipper strip transversely upon said sheet of thermoplastic sheet material is performed by a reciprocating shuttle having a clamp and a guillotine, said clamp being provided to pull said zipper strip from a supply transversely onto said sheet, and said guillotine being provided to cut said length of said zipper strip.

7. A method as claimed in claim 4 wherein the step of disposing a length of said zipper strip transversely upon said sheet of thermoplastic sheet material is performed by a pair of reciprocating clamps separated by a stationary guillotine, both of said reciprocating clamps grasping said zipper strip by said at least one flange thereof, one of said reciprocating clamps transferring said length of zipper strip cut by said guillotine onto said sheet of thermoplastic sheet material and holding said length during said sealing step, and the other of said reciprocating clamps pulling said zipper strip from a supply thereof toward said guillotine.

8. A method as claimed in claim 4 wherein the step of disposing a length of said zipper strip transversely upon said sheet of thermoplastic sheet material is performed by a vacuum conveyor means and a guillotine, said vacuum conveyor means pulling said zipper strip from a supply thereof and pulling lengths cut by said guillotine onto said sheet of thermoplastic sheet material.

9. A method as claimed in claim 4 wherein the motion of the sheet is incremental.

10. A method as claimed in claim 9 wherein said sheet is brought to rest when said length of zipper strip is attached.

11. A method as claimed in claim 4 wherein said at least one flange is oriented in the direction of the motion of said sheet.

12. A method as claimed in claim 4 wherein said at least one flange of said wider web is sealed to said sheet.

* * * * *